United States Patent [19]

Canning et al.

[11] Patent Number: 4,555,804

[45] Date of Patent: Nov. 26, 1985

[54] POUCH HANDLE

[75] Inventors: Howard Canning, Brantford; Peter Weber, Burlington, both of Canada

[73] Assignee: Twinpak, Inc., Dorval, Canada

[21] Appl. No.: 630,236

[22] Filed: Jul. 12, 1984

[51] Int. Cl.[4] ..... B65D 33/10

[52] U.S. Cl. ..... 383/25; 383/17

[58] Field of Search ..... 383/7, 9, 25, 17, 21, 383/78; 150/110

[56] References Cited

U.S. PATENT DOCUMENTS

| | | | |
|---|---|---|---|
| 2,050,967 | 8/1936 | Farmer | 383/9 |
| 2,732,872 | 1/1956 | Hurdle et al. | 383/25 |
| 2,745,593 | 5/1956 | Brady | 383/25 |
| 3,009,627 | 11/1961 | Ottinger | 383/78 |
| 3,013,655 | 12/1961 | Brody | 383/25 |
| 3,023,948 | 3/1962 | Hoeppner | 383/25 |
| 3,298,416 | 1/1967 | Grady | 383/78 |
| 3,484,037 | 12/1969 | Kugler | 383/21 |
| 3,678,977 | 7/1972 | Baumgartner | 150/110 |
| 3,722,786 | 3/1973 | Honn et al. | 383/78 |
| 4,247,005 | 1/1981 | Buxton | 383/7 |

FOREIGN PATENT DOCUMENTS

| | | | |
|---|---|---|---|
| 1131181 | 9/1982 | Canada | 383/25 |
| 2811219 | 9/1979 | Fed. Rep. of Germany | 383/21 |
| 2053590 | 4/1971 | France | 383/25 |

*Primary Examiner*—Stephen P. Garbe

[57] ABSTRACT

A flexible container including an elongated strip-handle having elongated outer edge portions, the strip-handle extending across a major outer surface of the container, the strip-handle being secured adjacent the ends thereof to the container, the improvement comprises, securing means located intermediate the ends of the strip-handle and located inboard of the elongated outer edge portions, fastening the strip-handle to the container, thereby providing additional securing of the strip-handle to the container, but still permitting the outer edge portions to remain unattached to the container. Also disclosed, is a method of securing an elongated strip-handle to a flexible container.

2 Claims, 3 Drawing Figures

POUCH HANDLE

BACKGROUND OF THE INVENTION (a) Field of the Invention

The present invention relates to improvements in securing carrying handles to flexible containers of the type used for liquids and other products, and accordingly improved flexible containers of the type mentioned.

(b) Description of Prior Art

An example of container or pouch with handle upon which improvement is provided by the present invention is disclosed in applicant's Canadian Pat. No. 1,131,181 dated Sept. 7, 1982.

SUMMARY OF INVENTION

It has been found, that additional securing of the handle to the container in a particular manner, results in a substantially more reinforced container and thus a much stronger container. The manner in which the additional securing is applied, according to the present invention, however, does not result in a less efficient handle and furthermore, provides reduction in stress at the points of attachment of the handle to the container adjacent the ends thereof. A further benefit afforded by the handle securing in accordance with the present invention, is that the container and its contents are better supported during a lifting operation by the handle, overcoming a buckling of the container as might occur in earlier designs, the repetition of which may lead to a weakening of the container.

The improved securing in accordance with the present invention, does not interfere with the option of having intelligence material printed on the container handle. A further benefit derived from the improved securing in accordance with the present invention, is that the handle gripping position is remote from the container. Such overcomes or reduces the probability of the container being damaged by a person's hand when engaging the handle, i.e. damage from sharp fingernails tending to pierce the container or by sharp abutments of a wearer's finger ring. In addition, the present handle design avoids the necessity of much hand contact with the container which is important for those involved in stacking such containers when refrigerated and cold.

It is an important aim of the present invention to provide an improved flexible container of the type mentioned and which overcomes the drawbacks alluded to.

It is a further important aim of the present invention to provide an improved method of securing a handle to a flexible container of the type mentioned.

A construction in accordance with the present invention includes a thermo-plastic flexible tubular pouch including a heat seal bond at the two extremities of the tubular pouch; a strip of flexible film material which may or may not include label intelligence printing thereon, the strip extending between the bonds and being connected to the extremities of the tubular pouch at the heat seal bond, the strip further being bonded intermediate its ends to the tubular pouch; the latter bonding being of continuous or intermittent type, the bonding thus being applied in a manner such that the strip comprises a carrying handle. The strip may or may not include one or more apertures intermediate its ends to accommodate a persons fingers when engaged in gripping the strip. The latter apertures and printing, as indicated elsewhere, would be normally applied prior to bonding of the strip-handle to the container.

In accordance with one aspect of the present invention, there is provided a method of securing an elongated strip-handle to a flexible container, so that the strip-handle extends across a major outer surface of the container, including the step of securing the strip-handle to the container intermediate the ends of the strip-handle, whereby the elongated marginal edges of the strip-handle are free and unattached to the container.

In accordance with a further aspect of the present invention, there is provided a flexible container including an elongated strip-handle having elongated outer edge portions, the strip-handle extending across a major outer surface of the container, the strip-handle being secured adjacent the ends thereof to the container, the improvement comprising, securing means located intermediate the ends of the strip-handle and located inboard of the elongated outer edge portions, fastening the strip-handle to the container, thereby providing additional securing of the strip-handle to the container, but still permitting the outer edge portions to remain unattached to the container.

BRIEF DESCRIPTION OF THE DRAWINGS

The invention is illustrated by way of example in the accompanying drawings, wherein.

DESCRIPTION OF PREFERRED EMBODIMENTS

Referring now in detail to the drawings.

Figure 1:
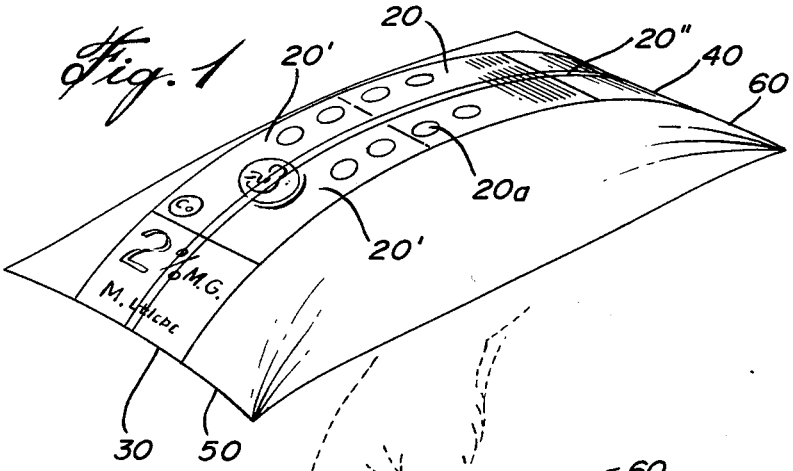
FIG. 1 is a perspective view of a typical flexible wall transparent container or pouch with strip-handle, in accordance with the present invention.

Referring to FIG. 1, there is seen a flexible wall pouch or container 10 having an elongated strip-handle 20, including elongated outer edge portions 20'. As seen, strip-handle 20 extends across a major outer surface of container 10 and is secured adjacent the ends or extremities 30 and 40 of container 10. Also, that strip-handle 20 is additionally secured to container 10 intermediate its ends along an axis 20''. Preferably, though not essential, axis 20'' extends along the central longitudinal axis of the strip-handle 20 to provide a pair of flanges of even width, which if desired, may include one or more apertures **20*a*** as shown, to facilitate finger gripping the flanges.

The additional securing along axis 20'' may comprise heat sealing as used in securing the ends or extremities 30 and 40 of the container 10 or alternatively, other suitable means. If desired, the additional securing may comprise spaced or intermittent sealing along axis 20'', the securing being of sufficient strength that container 10 is positively supported and secured to handle 20 when containing a product.

From the foregoing, it will be seen, the elongated marginal edges of the strip-handle are free and unattached to the container, permitting them to be flexed and be gripped together to thus provide a positive handle means.

Figure 2:
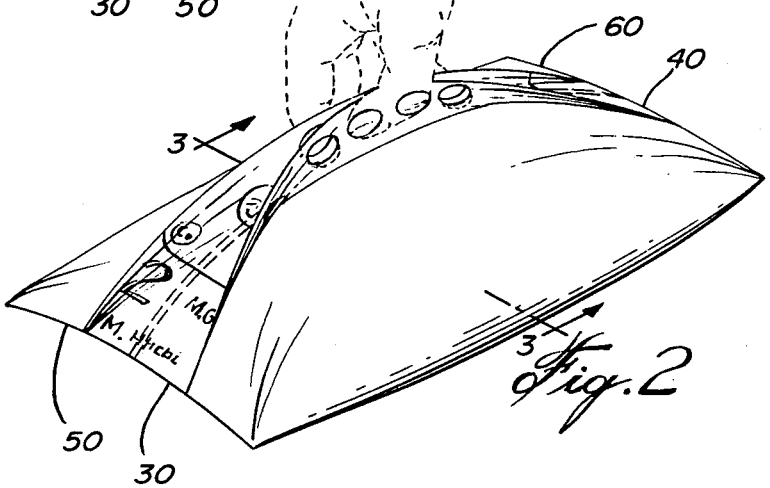
FIG. 2 is a perspective view showing the strip-handle in use.
Figure 3:
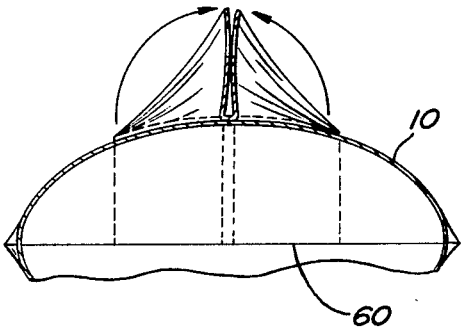
FIG. 3 is a vertical cross-sectional view taken along line 3—3 in FIG. 2.

Pouch or container 10, maybe formed of an elongated tube and may have an elongated seam such that the tube is formed in a liquid filling machine. In such instance, the tube has two ends which are sealed off once the liquid or other contents is in the pouch or container by a heat seal bond identified in FIGS. 1 and 2 as items 50 and 60. The heat seal bond may be applied by a conventional heat seal applicator which may comprise a stretched heated wire.

Strip-handle 20 may, as indicated previously, before being secured to pouch or container 10, be pre-printed either by colour coding it or by otherwise printing intelligence thereon for identifying the contents of the pouch or container 10.

We claim:

1. A flexible, relatively-limp package, comprising in combination, an elongated, flexible, limp container filled with a fluent material and sealed at opposite, transverse ends; and a relatively flat, flexible strip-handle element extending from end-to-end of said container, intermediately of opposite side edges of said container and lying in juxtaposed relation on the outer surface of the package when the package is at rest, means securing the strip-handle element at opposite ends to the opposite sealed ends of the container and longitudinally along the entire length of said strip handle element to said container and defining on opposite sides of the longitudinal seal, free, finger-grippable portions, the filled, limp package being flexed upwardly from its ends when lifted, said free, finger-grippable portions being juxtaposed, when the package is lifted, said finger-grippable portions having a compound curve configuration from the sealed ends of the package when it is lifted at said finger-grippable portions off a support surface whereby the load of the package is substantially distributed along all said seals when lifted.

2. The structure as claimed in claim 1 in which said strip-handle element includes apertures through said free, finger-grippable portions for accomodating a user's fingers and facilitating lifting of the limp, flexible package.

* * * * *